US005988633A

United States Patent [19]

Henn et al.

[11] Patent Number: 5,988,633

[45] Date of Patent: Nov. 23, 1999

[54] GUIDING DEVICE FOR A FRESHLY PRINTED SHEET

[75] Inventors: Manfred Henn, Heidelberg; Werner Kaul, Dossenheim; Martina Vettermann, Mauer, all of Germany

[73] Assignee: Heidelberger Druckmaschinen AG, Heidelberg, Germany

[21] Appl. No.: 08/835,493

[22] Filed: Apr. 8, 1997

Related U.S. Application Data

[63] Continuation of application No. PCT/DE96/01426, Jul. 29, 1996.

[30] Foreign Application Priority Data

Aug. 8, 1995 [DE] Germany ..... 195 29 119
Jul. 16, 1996 [DE] Germany ..... 196 28 620

[51] Int. Cl.[6] ..... B65H 29/24; B65H 29/04

[52] U.S. Cl. ..... 271/204; 271/195; 271/205

[58] Field of Search ..... 271/195, 204, 271/205; 406/86, 88; 414/676

[56] References Cited

U.S. PATENT DOCUMENTS

| | | | |
|---|---|---|---|
| 3,904,255 | 9/1975 | Neumann et al. | 406/88 |
| 4,860,687 | 8/1989 | Frijlink | 406/88 |
| 5,102,118 | 4/1992 | Vits | 271/195 |
| 5,108,513 | 4/1992 | Muller et al. | 406/88 |
| 5,411,251 | 5/1995 | Schmid et al. | 271/195 |
| 5,497,987 | 3/1996 | Henn et al. | 271/204 |
| 5,687,964 | 11/1997 | Stephan et al. | 271/195 |

FOREIGN PATENT DOCUMENTS

| | | |
|---|---|---|
| 0502417A1 | 9/1992 | European Pat. Off. . |
| 4014830A1 | 1/1991 | Germany . |
| 4113465A1 | 10/1992 | Germany . |
| 4308276A1 | 9/1994 | Germany . |
| 29501537 | 4/1995 | Germany . |
| 4242730C2 | 1/1997 | Germany . |
| 2255079B | 10/1992 | United Kingdom . |
| 2276150B | 9/1994 | United Kingdom . |
| 2297542A | 8/1996 | United Kingdom . |

*Primary Examiner*—William E. Terrell
*Assistant Examiner*—Wonki K. Park
*Attorney, Agent, or Firm*—Herbert L. Lerner; Laurence A. Greenberg

[57] ABSTRACT

A guiding device for a freshly printed sheet has a sheet-guiding surface, which is located at a distance from an imaginary conveying surface. The sheet has a leading edge, which sweeps over the imaginary conveying surface along a sheet transport direction perpendicular to the leading edge of the sheet. The sheet-guiding surface is formed on a guide-plate arrangement and has blast-air openings. The sheet-guiding surface includes blast-air nozzles of a first nozzle configuration and of at least a second nozzle configuration. The blast-air nozzles of the first nozzle configuration produce air-jets that sweep over the sheets and are aligned with respect to the sheet transport direction. The blast-air nozzles of the second nozzle configuration produce rotational flows sweeping over the sheets.

12 Claims, 4 Drawing Sheets

GUIDING DEVICE FOR A FRESHLY PRINTED SHEET

CROSS-REFERENCE TO RELATED APPLICATION

This application is a continuation of Application Ser. No. PCT/DE96/01426, filed Jul. 29, 1996.

BACKGROUND OF THE INVENTION

Field of the Invention

The invention relates to a guiding device for a freshly printed sheet, the leading edge of which sweeps over an imaginary conducting surface along a sheet travel direction perpendicular to the leading edge of the printed sheet, with a sheet-guiding surface following the conducting surface and located at a distance therefrom, the sheet-guiding surface being formed on a guide-plate arrangement and having blast-air openings distributed thereover and terminating therein; the invention relates further to a sheet-fed printing press with such a guiding device.

A guiding device of the aforementioned general type has become known heretofore, for example, from the published German Patent Document DE 43 08 276 A1, wherein blast-air nozzles are fitted into penetrations formed in a guide plate, the blast-air nozzles emitting during operation a blast-air jet out of flow channels which are disposed at an inclination to the sheet-guiding surface and leading into or terminating in the sheet-guiding surface. According to an exemplary embodiment of the thus known guiding device, the flow channels are aligned in the sheet travel direction and the blast-air nozzles are distributed over the sheet-guiding surface. The blast air escaping during operation from the flow channels produces an air flow between the sheet and the sheet-guiding surface, the intention being that the air flow should prevent contact between the sheet and the sheet-guiding surface.

A guiding device for sheets has become known heretofore from the published European Patent Document EP 0 502 417 A1, the guiding device being composed of a plurality of nozzle tubes extending in the sheet travel direction below the conducting surface which is swept by the leading edge of a sheet. Leading into or terminating at the upper side of these nozzle tubes are blast-air openings of blast-air nozzles which are inserted into the nozzle tubes, turbulent flows sweeping over the sheets being producible thereby.

SUMMARY OF THE INVENTION

It is accordingly an object of the invention to provide a guiding device for freshly printed sheets whereby sheets positively or forcibly guided at the leading edges thereof, are guided over a sheet-guiding surface without contacting the sheet-guiding surface.

With the foregoing and other objects in view, there is provided, in accordance with the invention, a guiding device for a freshly printed sheet having a leading edge which sweeps over an imaginary conducting surface along a sheet transport direction perpendicular to the leading edge of the sheet, with a sheet-guiding surface following the conducting surface and located at a distance therefrom, the sheet-guiding surface being formed on a guide-plate arrangement and having blast-air openings distributed thereover and terminating therein, comprising blast-air nozzles of a first nozzle configuration and of at least a second nozzle configuration, the blast-air nozzles, respectively, having the blast-air openings formed therein, the blast-air nozzles of the first nozzle configuration being capable of producing air-jet bundles sweepable over the sheets and being aligned with respect to the sheet transport direction, and the blast-air nozzles of the second nozzle configuration being capable of producing turbulent flows sweepable over the sheets.

In accordance with another feature of the invention, the sheet-guiding surface is formed of sections along the sheet-guiding surface which are particularly endangered with regard to a possible deposition of ink on the sheet-guiding surface, and the blast-air nozzles of the second nozzle configuration forming at least a considerable proportion of the blast-air nozzles disposed in the endangered sections.

In accordance with a further feature of the invention, the blast-air openings in the blast-air nozzles of the second nozzle configuration are formed by gaps provided in the sheet-guiding surface, the gaps being formed by regions of a respective guide-plate section of the guide-plate arrangement extending at a substantially like angle away from the conducting surface, the regions extending at least substantially between imaginary pairs of concentric circles over at least substantially identical angles uniformly distributed over 360° and forming guide-plate lugs, the guide-plate lugs being integrally connected, at corresponding ends of the angled-away sections, to the respective guide-plate section.

In accordance with an added feature of the invention, the blast-air openings formed in the blast-air nozzles of the second nozzle configuration are formed by gaps provided in the sheet-guiding surface, the gaps being formed by channel sections pressed into the guide-plate arrangement, the channel sections extending at least substantially between imaginary pairs of concentric circles over at least substantially identical angles uniformly distributed over 360°; the channel sections, respectively, having channel bottoms starting from the sheet-guiding surface at corresponding first ends of the channel sections and being inclined with respect to the sheet-guiding surface in a direction extending away from the conducting surface, and having open channel end faces at second ends of the channel sections located opposite the first ends thereof.

In accordance with an additional feature of the invention, the blast-air openings formed in the blast-air nozzles of the second nozzle configuration are formed by gaps provided in the sheet-guiding surface, the gaps extending at least substantially between imaginary pairs of concentric circles over at least substantially identical angles uniformly distributed over 360°, each of the gaps being formed by a first cut in the guide-plate arrangement, the first cut being situated radially inwardly with respect to the respective pair of concentric circles and being oriented at least substantially in the circumferential direction of the concentric circles; and a second cut adjoining a first end of the first cut and extending at least substantially radially with respect to the respective pair of concentric circles; and a deformation of respective regions of the guide-plate arrangement, the respective regions being situated between the respective pair of concentric circles and extending along the first cut, the deformation being such that cut edges of the regions formed by the first and the second cuts, while forming a gap, extending along the cut edges, between the cut edges and corresponding cut edges of a nondeformed part of the guide-plate arrangement, are lowered in like direction with respect to the sheet-guiding surface, the direction extending away from the conducting surface.

In accordance with yet another feature of the invention, the deformed regions, respectively, are formed in the manner of a notch with a maximally lowered notch line, the notch line, starting from a lowest level at a corner of one of the deformed regions corresponding with the first end of the first cut, rising with increasing distance from the first cut.

In accordance with yet a further feature of the invention, the guiding device includes a nozzle body fittable on a side of the guide-plate section facing away from the conducting surface being connectable upstream of a respective blast-air nozzle of the second nozzle configuration, the nozzle body having spiral channels formed therein upon which blast air is actable, each of the spiral channels communicating with a respective one of the gaps distributed over 360°.

In accordance with yet an added feature of the invention, the guiding device includes blast-air ducts extending transversely to the sheet transport direction, the blast-air ducts communicating with the blast-air nozzles for supplying thereto blast air to act upon the blast-air nozzles.

In accordance with yet an additional feature of the invention, the sheet-guiding surface has an inlet region furnished with blast-air nozzles of a third nozzle configuration, the blast-air nozzles of the third nozzle configuration being formed with blast-air openings formed of holes in the guide-plate section.

In accordance with still another feature of the invention, the sheet-guiding surface has an inlet region furnished with blast-air nozzles of the first nozzle configuration, the blast-air nozzles of the first nozzle configuration in the inlet region being aligned in such a manner that therewith producible air-jet bundles are directed opposite to the sheet transport direction.

In accordance with still an added feature of the invention, the inlet region is also furnished with blast-air nozzles of the first nozzle configuration, the air-jet bundles producible by the blast-air nozzles of the first nozzle configuration being oriented opposite to the sheet transport direction, the blast-air nozzles of the first nozzle configuration being disposed downstream from the blast-air nozzles of the third nozzle configuration, as viewed in the sheet transport direction.

In accordance with still an additional feature of the invention, the guiding device includes blast-air nozzles of the first nozzle configuration in regions of the sheet-guiding surface situated downstream from an inlet region of the sheet-guiding surface, with respect to the sheet-transport direction, the last-mentioned blast-air nozzles being disposed in such a manner that the air-jet bundles producible by the last-mentioned blast-air nozzles are oriented at least substantially in the sheet transport direction.

In accordance with a concomitant feature of the invention, the guiding device is in combination with a sheet-fed printing press.

The furnishing of the guide-plate arrangement with blast-air nozzles of the first nozzle configuration and of at least a second nozzle configuration, according to the invention, makes it possible to provide an extensively closed air cushion between the sheet-guiding surface and the sheet. In particular, such a construction allows an optimization of the load-bearing capacity of the aforementioned air cushion across the entire region of the sheet-guiding surface covered by the sheet.

A particularly advantageous embodiment of the guiding device according to the invention results in that, in sections along the sheet-guiding surface which are particularly endangered by a possible deposition of ink on the sheet-guiding surface, blast-air nozzles belonging to the second nozzle configuration form at least a considerable proportion of the blast-air nozzles provided in the sections.

An embodiment favorable from a manufacturing viewpoint results in the blast-air openings of the blast-air nozzles belonging to the second nozzle configuration being formed by gaps provided in the sheet-guiding surface, the gaps being created by the regions of a guide-plate section of the guide-plate arrangement being identically angled-away from the conducting surface, these regions extending at least substantially between imaginary pairs of concentric circles over at least substantially identical angles uniformly distributed over 360° and forming guide-plate lugs, the guide-plate lugs being integrally connected, at corresponding ends of the angled-away sections, to the guide-plate section.

An embodiment of the blast-air nozzles of the second nozzle configuration just as advantageous from the manufacturing viewpoint as from the functional viewpoint has blast-air openings formed by gaps provided in the sheet-guiding surface, the gaps being created by channel sections pressed into the guide-plate arrangement, the channel sections extending at least substantially between imaginary pairs of concentric circles over at least substantially identical angles uniformly distributed over 360°, the channel sections, respectively, having channel bottoms starting from the sheet-guiding surface at corresponding first ends of the channel sections and being inclined with respect to the sheet-guiding surface in a direction extending away from the conducting surface; and having open channel end faces at second ends of the channel sections opposite to the first ends thereof.

A further embodiment of the blast-air nozzles of the second nozzle configuration which is advantageous from the manufacturing and functional viewpoints is provided with blast-air openings formed by gaps provided in the sheet-guiding surface, the gaps extending at least substantially between imaginary pairs of concentric circles over at least substantially identical angles uniformly distributed over 360°, each of the gaps being created by a first cut in the guide-plate arrangement, the first cut being situated radially inwardly with respect to the respective pair of concentric circles and being oriented at least substantially in the circumferential direction of the concentric circles; and having a second cut adjoining a first end of the first cut and extending at least substantially radially with respect to the respective pair of concentric circles; and a deformation of respective regions of the guide-plate arrangement, the regions being situated between the respective pair of concentric circles and extending along the first cut, the deformation being such that cut edges of the regions formed by the first and the second cuts, while forming a gap, extending along the cut edges, between the cut edges and corresponding cut edges of the nondeformed part of the guide-plate arrangement, are lowered in the same direction with respect to the sheet-guiding surface in a direction extending away from the conducting surface.

In a special embodiment thereof, each of the deformed regions is formed in the manner of a notch with a maximally lowered notch line, the notch line, starting from a lowest level at a corner of one of the deformed regions corresponding with the first end of the first cut, rising with increasing distance from the first cut.

With regard to the blast-air nozzles of the second nozzle configuration, it may prove advantageous that nozzle bodies be fitted to a side of the guide-plate section facing away from the conducting surface, each nozzle body being associated with one of the gaps distributed over 360°, spiral channels, acted upon by blast air, being formed in each of the nozzle bodies, each of the channels communicating with one of the gaps distributed over 360°.

A preferred embodiment of the guiding device has blast-air ducts extending transversely with respect to the sheet-transport direction; through the intermediary of the blast-air ducts, the blast-air nozzles are acted upon by blast air. This embodiment ensures that the blast-air nozzles will be acted upon row by row with blast air in rows extending transversely with respect to the sheet transport direction, independently of adjacent rows, with the result that different parameters of the blast air can be provided on a row-by-row basis.

In an advantageous embodiment, an inlet region of the sheet-guiding surface is furnished with blast-air nozzles of a third nozzle configuration, the blast-air nozzles of the third nozzle configuration being formed with blast-air openings in the form of holes provided in the guide-plate arrangement.

In a different embodiment, an inlet region of the sheet-guiding surface is furnished with blast-air openings of the first nozzle configuration, the blast-air openings being disposed in such a manner that the therewith producible air-jet bundles are directed opposite to the sheet transport direction.

Particularly advantageous is an embodiment wherein the inlet region is furnished with blast-air nozzles of the first and the third nozzle configurations, the air-jet bundles producible by the blast-air nozzles of the first nozzle configuration being oriented opposite to the sheet transport direction, and the blast-air nozzles of the first nozzle configuration, as viewed in the sheet transport direction, being disposed after or downstream from the blast-air nozzles of the third nozzle configuration.

Also preferred is an arrangement wherein blast-air nozzles belonging to the first nozzle configuration in regions of the sheet-guiding surface, regions which are situated upstream from an inlet region of the sheet-guiding surface, with respect to the sheet transport direction, are disposed in such a manner that the air-jet bundles producible by the blast-air nozzles are oriented at least substantially in the sheet transport direction.

Other features which are considered as characteristic for the invention are set forth in the appended claims.

Although the invention is illustrated and described herein as embodied in a guiding device for a freshly printed sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings wherein:

DESCRIPTION OF THE PREFERRED EMBODIMENTS

Figure 1:
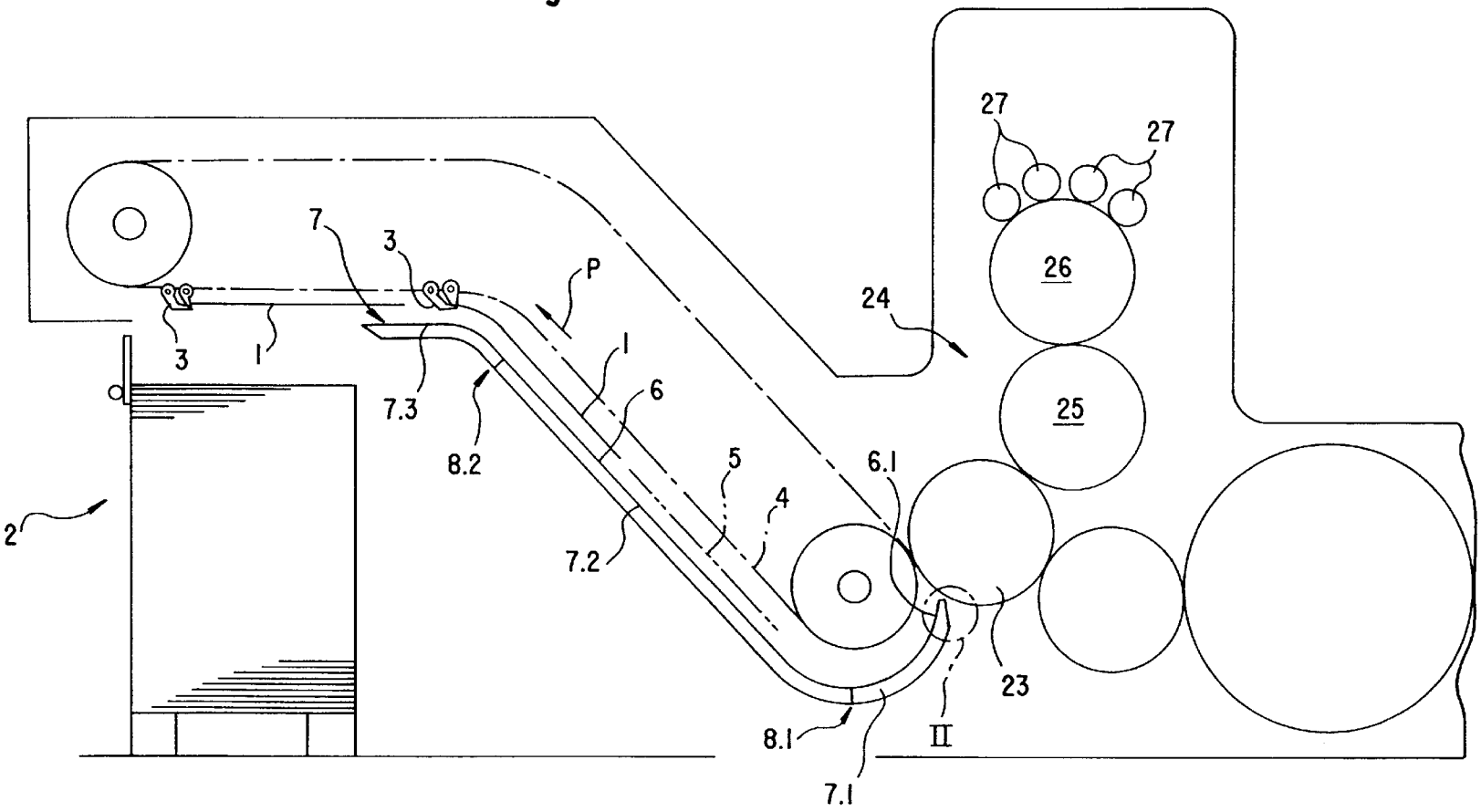
FIG. 1 is a diagrammatic side elevational view of a chain delivery of a sheet-fed printing press showing a sheet-guiding surface in association with a conducting surface, in accordance with the invention.

Referring now to the drawings and, first, particularly to FIG. 1 thereof, there is diagrammatically shown therein the leading edges of respective sheets 1 which are held by gripper systems 3, during the transport of the sheets 1 towards a sheet pile apparatus 2 in a delivery of a sheet-fed printing press, the gripper systems 3 being articulatedly connected to revolving chains 4, so that the leading edges of the sheets 1 sweep over an imaginary conducting surface 5 in a sheet travel direction represented by the arrow P perpendicularly to the leading edges of the sheets 1. The conducting surface 5 is followed, at a spaced distance therefrom, by a sheet-guiding surface 6 in the form of a surface of a guide-plate arrangement 7. In the illustrated embodiment of FIG. 1, the guide-plate arrangement 7 is made up of guide-plate sections 7.1, 7.2 and 7.3, which are joined together at contact locations 8.1, 8.2 extending transversely to the sheet travel direction.

The guide-plate arrangement 7 forms an inlet region 6.1 of the sheet-guiding surface 6. The inlet region 6.1 is in the immediate vicinity of the impression cylinder 23 of a printing unit 24 of a printing press, wherein the printing unit 24 transfers the sheets 1 to a gripper system 3. In the embodiment illustrated in FIG. 1, the printing press is an offset printing press which is broadly outlined, in particular, without an appertaining feeder. The printing unit 24 is represented, in particular, by the aforementioned impression cylinder 23, an offset cylinder 25 and a plate cylinder 26. A dampening unit which may be included is not represented, and an inking unit which cooperates with the plate cylinder 26 is represented only in simplified form by inking rollers 27 thereof. Likewise, grippers of the impression cylinder 23 which transfer the sheets 1 to a respective gripper system 3 have not been shown. In order to prevent collisions of the grippers of the impression cylinder 23 with the guide-plate arrangement 7, the latter is provided in the inlet region 6.1 with cutouts 28 visible in FIG. 2.

Figure 2:
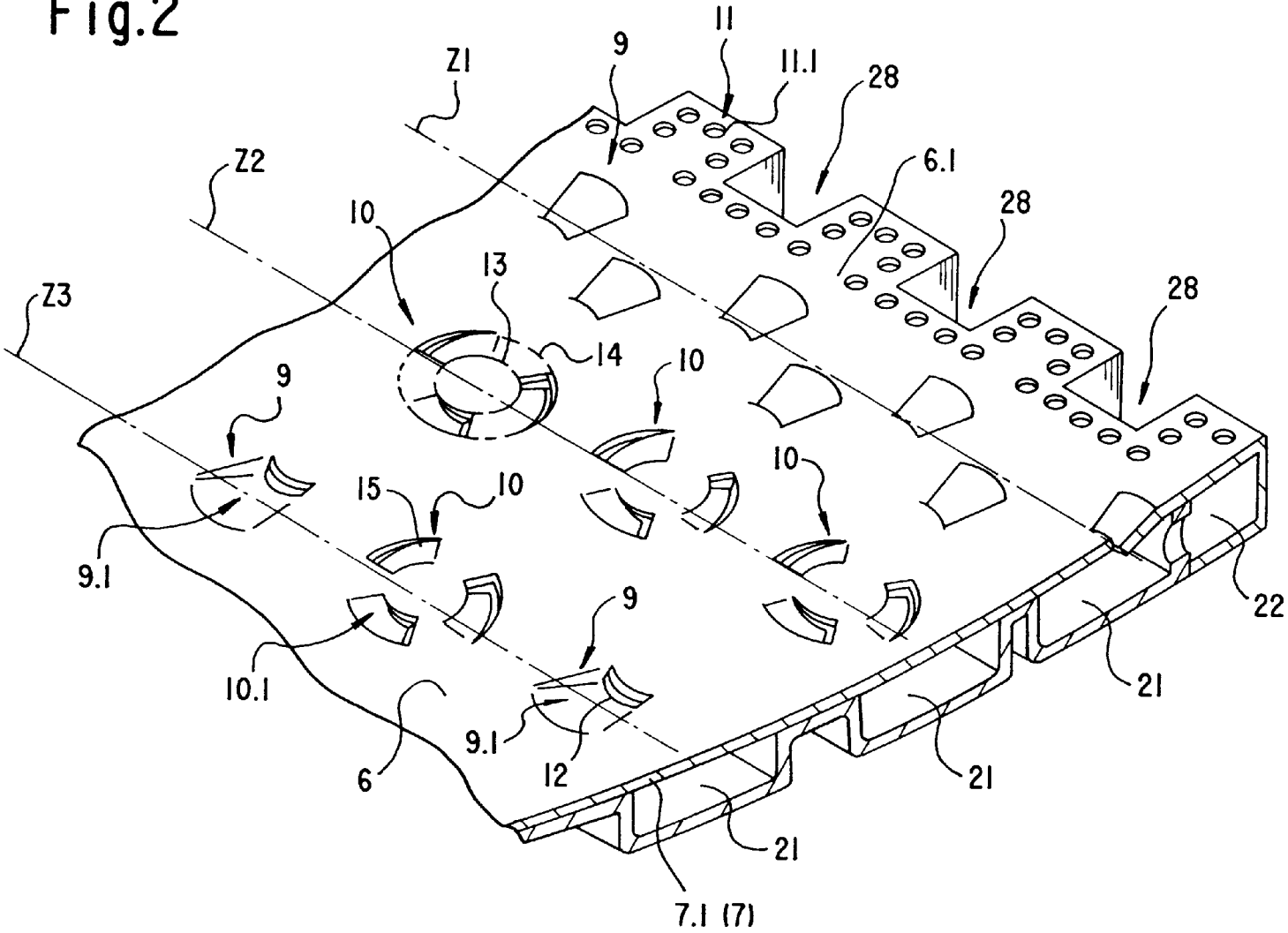
FIG. 2 is an enlarged fragmentary perspective view, partly in section, of FIG. 1 showing an encircled part II of an exemplary embodiment of the guiding device according to the invention.

As is indicated in FIG. 2, blast-air openings 9.1, 10.1 and 11.1 are distributed over the sheet-guiding surface 6, the blast-air openings 9.1, 10.1 and 11.1 being formed on blast-air nozzles 9, 10 and 11 of first, second and third nozzle configurations, respectively, and leading into or terminating in the sheet-guiding surface 6. In this regard, the blast-air nozzles 9 belonging to the first nozzle configuration are formed in such a manner that they are capable of producing air-jet bundles aligned with the sheet travel or transport direction. For this purpose, the construction of each of the blast-air nozzles 9 provides for an inclined lowering, in a direction away from the conducting surface 5, of a region in a guide-plate section 7.1 or 7.2 or 7.3 which is shaped as an approximately circular-ring section, so that a lowered cut edge is produced which is situated radially inwardly with respect to the region shaped as a circular-ring section, an air gap 12 being formed between the cut edge and the corresponding cut edge on the yet nondeformed guide-plate section 7.1 or 7.2 or 7.3, blast air flowing during operation through the air gap 12 and subsequently flowing out of the sheet-guiding surface 6 through a blast-air opening 9.1 in the form of a gap left in the sheet-guiding surface 6 by the lowered region.

The thus constructed blast-air nozzles 9 are oriented in regions of the sheet-guiding surface 6 which are situated, as viewed in the sheet transport or travel direction, downstream from a hereinafterdescribed inlet region 6.1, in such a manner that the inclined region of the guide-plate section 7.1 or 7.2 or 7.3 shaped as an approximately circular-ring section, starting from the aforementioned gap 12, rises at least substantially in the sheet travel direction. The air-jet bundles producible with the blast-air nozzles 9 are consequently aligned with the sheet travel direction and have a main flow direction extending in the sheet travel direction.

Diverging therefrom, in an embodiment not shown in the drawings, the blast-air nozzles 9 are disposed within the aforementioned regions in such a manner that the central jets of the air-jet bundles produced by blast-air nozzles 9 situated, on the one hand, to the left-hand side, and, on the other hand, to the right-hand side of the center line of the guide-plate sections 7.1 or 7.2 or 7.3 are inclined with respect to one another so that they enclose an angle which opens in the sheet travel direction.

In a first exemplary embodiment of the blast-air nozzles 10 of the second nozzle configuration, the blast-air openings 10.1 thereof are likewise in the form of specially shaped gaps in the sheet-guiding surface 6. These gaps extend over substantially identical angles, uniformly distributed over 360°, between imaginary pairs of concentric circles 13 and 14 and, in the example shown, having the form of circular-ring sections. These gaps are formed by the angling away from the conducting surface 5 of each region of the guide-plate section 7.1 or 7.2 or 7.3 having the form of one of the circular-ring sections, in such a manner that, after angling away, each of the regions forms a guide-plate lug 15 which remains integrally connected at one end of one of the respective circular-ring sections to the guide-plate section 7.1 or 7.2 or 7.3.

It is not mandatory, however, that the gaps should extend over precisely identical angles or that the gaps should be distributed precisely uniformly over 360°; to the same extent, it is also not mandatory that the gaps should have the precise form of circular-ring sections. For example, the gaps may also be rectilinear in form. This applies also to embodiments of the blast-air nozzles 10' and 10" of the second nozzle configuration which are described hereinafter.

Figure 3:
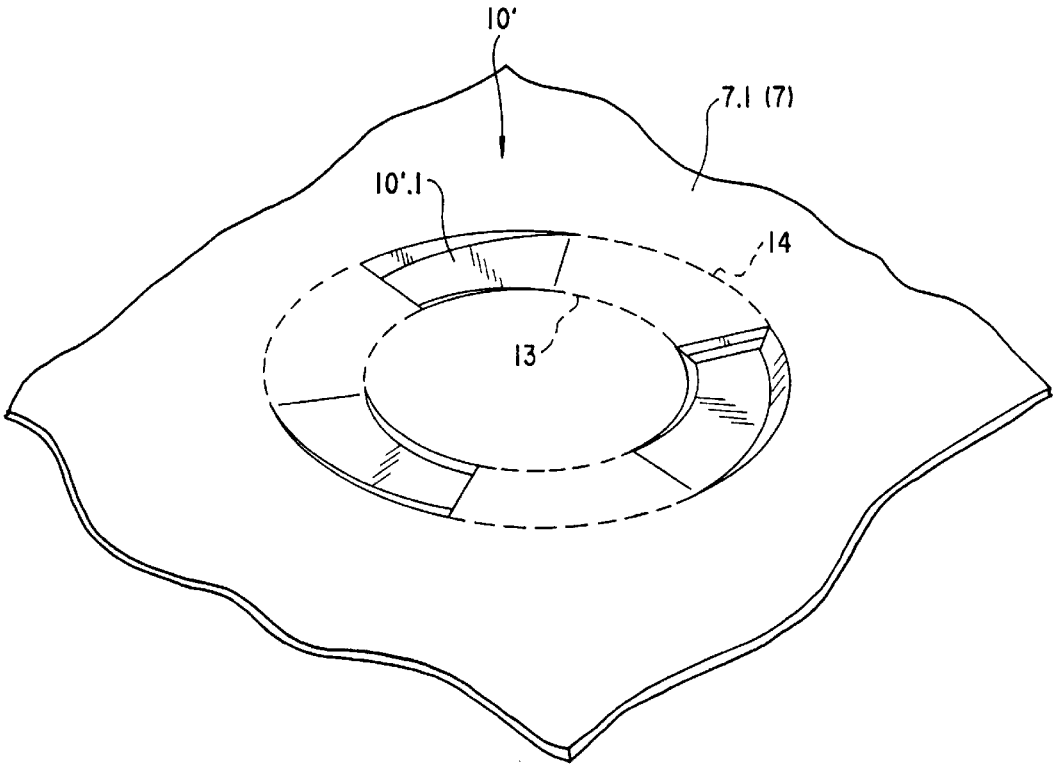
FIG. 3 is an enlarged fragmentary perspective view of FIG. 2 showing a different embodiment of a blast-air nozzle of a second nozzle configuration.

In a second exemplary embodiment of the blast-air nozzles 10' of the second nozzle configuration, the gaps in the sheet-guiding surface 6 constituting the blast-air openings 10'.1 are created by channel sections pressed into the guide-plate arrangement 7 (note FIG. 3). The channel sections extend at least somewhat likewise between imaginary pairs of concentric circles 13, 14 and over at least substantially identical angles uniformly distributed over 360°. The channel sections, respectively, are formed with channel bottoms, which are inclined so that the channel bottoms originate from the sheet-guiding surface 6 at corresponding first ends of the channel sections and are inclined with respect to the sheet-guiding surface 6 in a direction extending away from the conducting surface 5. The channel sections are formed with open channel end faces at second ends of the channel sections located opposite to the first ends thereof.

Figure 4:
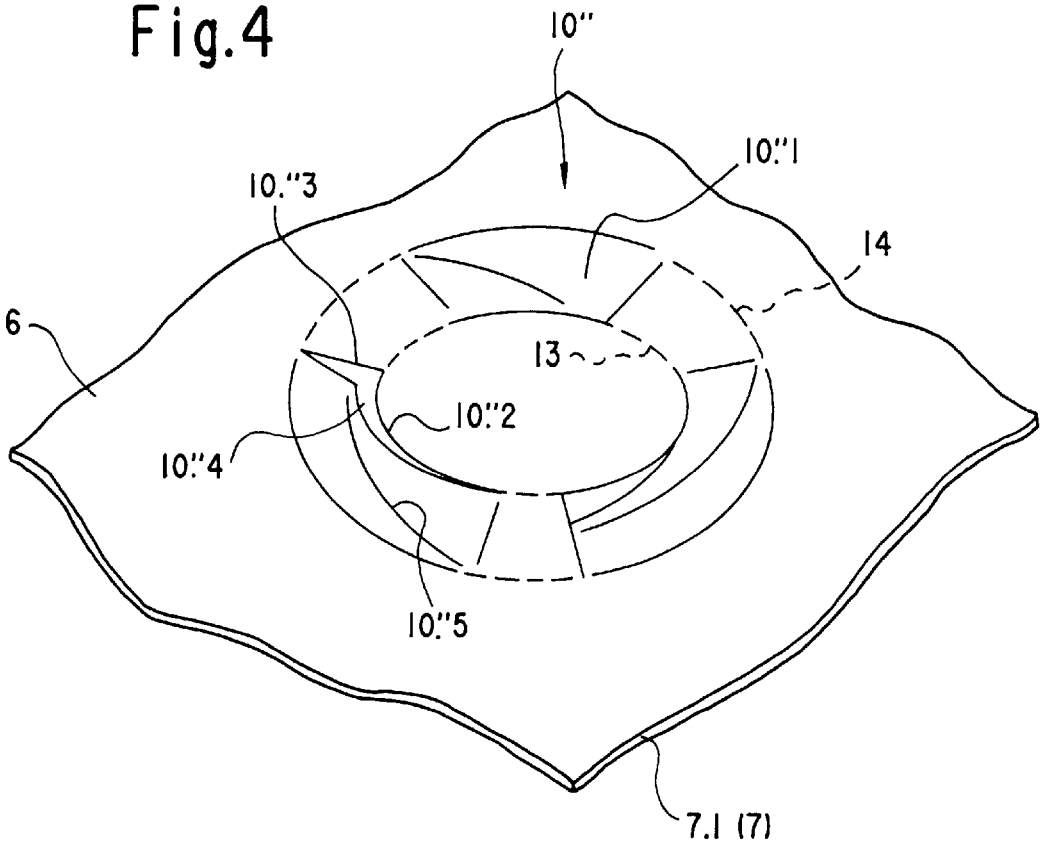
FIG. 4 is another view like that of FIG. 3 of a third different embodiment of the blast-air nozzle of the second nozzle configuration.

In a further exemplary embodiment of the blast-air nozzles 10" of the second nozzle configuration according to FIG. 4, the blast-air openings 10".1 are once formed by gaps provided in the sheet-guiding surface 6, the form and arrangement of the gaps corresponding basically to factors relating to the aforedescribed exemplary embodiments according to FIG. 2 and FIG. 3. Diverging therefrom, however, each of the gaps is formed by a first cut 10".2 situated radially inwardly of the respective pair of concentric circles 13 and 14 and being oriented at least substantially in the circumferential direction of the circles 13 and 14; also by a second cut 10".3 adjoining a first end of the first cut 10".2 and extending at least substantially radially to the circles 13 and 14; as well as by a deformation of respective regions of the guide-plate arrangement 7, those regions being situated between the respective pair of concentric circles and extending along the first cut 10".2, the deformation being such that cut edges of the regions formed by the first and second cuts 10".2 and 10".3 are lowered, in the same direction with respect to the sheet-guiding surface 6, in a direction extending away from the conducting surface 5, the lowered cut edges forming a gap 10".4, extending along the cut edges, between the cut edges and corresponding cut edges of the nondeformed part of the guide-plate arrangement 7.

In a further embodiment, each of the deformed regions is formed in the manner of a notch with a maximally lowered notch line 10".5 which, starting from a lowest level at a corner of one of the deformed regions corresponding to the first end of the first cut 10".2, rising with increasing distance from the first cut 10".2.

The aforementioned notches as well as the aforementioned channel bottoms and guide-plate lugs 15 can be formed, at a reasonable ease of manufacture, with a smooth transition to the sheet-guiding surface 6. This has an advantageous effect upon the flow pattern of the turbulent flows produced therewith and, to that extent, has a favorable effect upon the contactfree guidance of the sheet 1.

In a further embodiment, a nozzle body 16, fittable to a side of the guide-plate section 7.1, 7.2, 7.3 facing away from the conducting surface 5, is connectable upstream of a blast-air nozzle 10, 10', 10" of the second nozzle configuration (note FIG. 4). The nozzle body 16 is formed with spiral channels 17, subjectible to blast air, each of the spiral channels 17 communicating with a respective one of the gaps in the sheet-guiding surface 6 distributed over 360°. Depending upon the construction of the nozzle body 16, the channels 17 are spirally formed in such a manner that, in a first embodiment, they terminate with a right-hand turn and, in a second embodiment, with a left-hand turn in a respective gap. Accordingly, in the case of gaps formed by angled-away guide-plate lugs 15, the latter, which are associated with respective nozzle bodies 16 and distributed over 360°, are angled-away in identical directions with respect to the guide-plate section 7.1 or 7.2 or 7.3 in such a manner that, in a first embodiment, they rise with a right-hand turn and, in a second embodiment, with a left-hand turn from the free end of a respective guide-plate lug 15 towards the sheet-guiding surface 6, the pitch being identical to that of the spiral channels 17 in the nozzle body 16.

Figure 5:
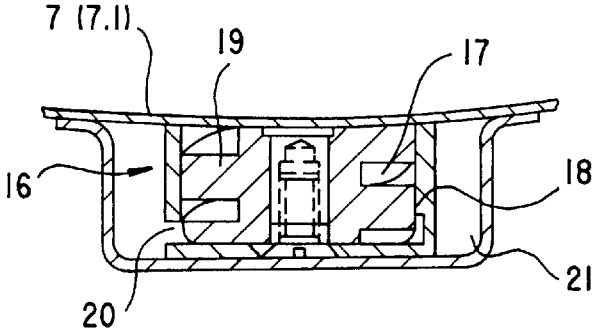
FIG. 5 is a sectional view of a nozzle body associated with a blast-air nozzle of the second nozzle configuration, the section being taken transversely to a blast-air duct.

In the exemplary embodiment shown in FIG. 5, the nozzle body 16 is formed from a circular-cylindrical cup 18 and a worm 19, fitted therein, with a number of threads adapted to the number of guide-plate lugs 15 distributed over 360°. The spirals or coils of the worm 19 thus covered by the cup 18 form the channels 17, which, in this embodiment, have a rectangular cross section. At the base of the cup 18, the cylindrical wall thereof is provided with openings 20, which communicate with a respective channel 17 and serve to act upon the latter with blast air. Each of the guide-plate lugs 15, distributed over 360°, projects into a channel 17 of the nozzle body 16 and, with an underside of the respective guide-plate lug 15, facing away from the sheet-guiding surface 6, contacts a flank or side of one of the spirals forming the worm 19, facing towards the sheet-guiding surface.

As indicated in FIG. 2, the blast-air nozzles 9 and 10 of the first and the second nozzle configurations are distributed over the sheet-guiding surface 6 in rows Z1 to Z3, and so forth extending transversely to the sheet-transport direction represented by the arrow P in FIG. 1. Each row Z1 to Z3, and so forth has a blast-air duct 21 associated therewith, by which the blast-air nozzles disposed in the row are acted upon by blast air. In the case of blast-air nozzles 10 of the second nozzle configuration, which are disposed in one of the rows Z2 to Z3, and so forth, the corresponding nozzle bodies 16 are enclosed, according to FIG. 4, in the blast-air duct 21 associated with the respective row Z2 to Z3, and so forth.

As can be seen from FIG. 4, for this purpose, the respective blast-air duct 21 is fitted, with an open side thereof, to a side of the guide-plate section 7.1 or 7.2 or 7.3, facing away from the sheet-guiding surface 6, and is covered thereby.

The guide-plate arrangement 7, of course, has an inlet region 6.1 of the sheet-guiding surface 6. In the detail reproduced in FIG. 2 of the part of the guiding device shown surrounded by the circle II in FIG. 1, the inlet region 6.1 is situated, as viewed in the sheet transport or travel direction represented by the arrow P, before or upstream of the second row Z2.

In the exemplary embodiment shown in FIG. 2, for the outfitting of the sheet-guiding surface 6 with blast-air nozzles, the aforementioned inlet region 6.1 is provided, in particular, with blast-air nozzles 9 of the first nozzle configuration and with blast-air nozzles 11 of a third nozzle configuration, the blast-air nozzles 11 being formed with blast-air openings 11.1 in the form of holes provided in the guide-plate section 7.1. In this exemplary embodiment, the blast-air openings 11.1 are supplied with blast air from chambers 22. Each of the chambers 22 is covered on a top side thereof by the guide-plate section 7.1. The chamber 22 adjoins, opposite to the sheet transport or travel direction represented by the arrow P in FIG. 1, a longitudinal side of the blast-air duct 21 associated with the first row Z1 and is in communication with the blast-air duct 21 through the intermediary of a penetration or opening formed in the aforementioned longitudinal side of the blast-air duct 21.

In the exemplary embodiment shown in FIG. 2, the inlet region 6.1 is furnished with blast-air nozzles 11 and 9, respectively, belonging to the third and first nozzle configurations. Disposed in row Z1, the blast-air nozzles 9 of the first nozzle configuration come, as viewed in the sheet transport or travel direction, after or downstream from the blast-air nozzles 11 of the third nozzle configuration, and they are disposed in such a manner that the therewith producible air-jet bundles are directed opposite to the sheet transport direction. The corresponding arrangement is achieved in that the inclined regions of the guide-plate section 7.1, which form the blast-air nozzles 9 in the inlet region 6.1, those regions having the shape of a section of an approximately circular ring, rise in a direction opposite to the sheet transport direction.

A section of the sheet-guiding surface 6 following the inlet region 6.1 is to be viewed, particularly if the sheet-guiding surface 6 is curved in the sheet-transport direction, as a section of the sheet-guiding surface 6 which is particularly endangered with regard to the possible deposition of ink. In such a section, blast-air nozzles 10 belonging to the second nozzle configuration form at least a considerable proportion of the blast-air nozzles 9 or 10 provided in the section. Consequently, in the embodiment shown in FIG. 2, the row Z2 coming directly after or downstream from the inlet region 6.1 is filled without exception with the blast-air nozzles 10 belonging to the second nozzle configuration. This may also be advisable for one or more following rows in the sheet transport direction. Further following rows are then filled at least with blast-air nozzles 9 of the first nozzle configuration until the next particularly endangered section, the blast-air nozzles 9 being aligned in such a manner that the central jets of the therewith producible air-jet bundles have a main flow direction extending in the sheet transport direction. With regard to the filling of each of the respective rows, however, it is also possible alternately to provide blast-air nozzles 9 of the first nozzle configuration and blast-air nozzles 10 of the second nozzle configuration, as is represented, by way of example, in row Z3. It is advantageous in this respect that the order of the blast-air nozzles of the first and the second nozzle configurations within the respective row should change from row to row.

Further to be viewed as a section of the sheet-guiding surface 6 which is particularly endangered with regard to the possible deposition of ink, even with a flat sheet-guiding surface 6, is a section wherein, for example, the guide-plate sections 7.2 and 7.3 are joined to one another to form the butt joint 8.2.

Further to be considered as a section of the sheet-guiding surface 6 which is particularly endangered with regard to the possible deposition of ink is a section wherein, following a flat section, the sheet-guiding surface 6, with a change of direction, merges with a further flat section.

We claim:

1. A guiding device for a freshly printed sheet having a leading edge which sweeps over an imaginary conveying surface along a sheet transport direction perpendicular to the leading edge of the sheet, comprising:

a guide-plate arrangement having a sheet-guiding surface with an inlet region and located at a distance from the imaginary conveying surface, said sheet-guiding surface having blast-air openings distributed thereover and terminating therein, blast-air nozzles of a first nozzle configuration and of at least a second nozzle configuration, said blast-air nozzles, respectively, having said blast-air openings formed therein, said blast-air nozzles of said first nozzle configuration being capable of producing air jets sweepable over the sheets and being aligned with respect to the sheet transport direction, at least some of said blast air nozzles of said first nozzle configuration located downstream of said inlet region and producing air jets having a main flow direction extending at least substantially in the sheet transport direction, and said blast-air nozzles of said second nozzle configuration capable of producing rotational flows sweepable over the sheets; and a revolving gripper system operatively connected to the guide-plate arrangement for holding a leading edge of the sheet such that the leading edge sweeps over the imaginary conveying surface along the sheet transport direction.

2. The guiding device according to claim 1, wherein said sheet-guiding surface is formed of sections along said sheet-guiding surface which are particularly prone to a possible deposition of ink on the sheet-guiding surface, and said blast-air nozzles of said second nozzle configuration forming at least a considerable proportion of said blast-air nozzles disposed in said sections prone to a deposition of ink.

3. The guiding device according to claim 1, wherein said blast-air openings in said blast-air nozzles of said second nozzle configuration are formed by gaps provided in said sheet-guiding surface, said gaps being formed by regions of a respective guide-plate section of said guide-plate arrangement said regions bent away from the conveying surface, and extending at least substantially between imaginary pairs of concentric circles over at least substantially identical angles uniformly distributed over 360° and forming guide-plate lugs, said guide-plate lugs being integrally connected, at corresponding ends of the bent-away sections, to the respective guide-plate section.

4. The guiding device according to claim 1, wherein the blast-air openings formed in said blast-air nozzles of said second nozzle configuration are formed by gaps provided in the sheet-guiding surface, said gaps being formed by channel sections pressed into the guide-plate arrangement, said channel sections extending at least substantially between imaginary pairs of concentric circles over at least substantially identical angles uniformly distributed over 360°; said channel sections, respectively, having channel bottoms starting from the sheet-guiding surface at corresponding first ends of said channel sections and being inclined with respect to the sheet-guiding surface in a direction extending away from the conveying surface, and having open channel end faces at second ends of said channel sections located opposite said first ends thereof.

5. The guiding device according to claim 1, wherein the blast-air openings formed in said blast-air nozzles of said second nozzle configuration are formed by gaps provided in the sheet-guiding surface, said gaps extending at least substantially between imaginary pairs of concentric circles over at least substantially identical angles uniformly distributed over 360°, each of said gaps being formed by a first cut in the guide-plate arrangement, said first cut being situated radially inwardly with respect to the respective pair of concentric circles and being oriented at least substantially in the circumferential direction of said concentric circles; and including a second cut adjoining a first end of said first cut and extending at least substantially radially with respect to the respective pair of concentric circles; and a deformation of respective regions of the guide-plate arrangement, said respective regions being situated between the respective pair of concentric circles and extending along said first cut, said deformation being such that cut edges of said regions formed by said first and said second cuts, while forming a gap, extending along said cut edges, between said cut edges and corresponding cut edges of a nondeformed part of the guide-plate arrangement, are lowered in like direction with respect to the sheet-guiding surface, said direction extending away from the conveying surface.

6. The guiding device according to claim 5, wherein said deformed regions, respectively, are formed in the manner of a notch with a maximally lowered notch line, said notch line, starting from a lowest level at a corner of one of the deformed regions corresponding with said first end of said first cut, rising with increasing distance from said first cut.

7. The guiding device according to claim 3, including a nozzle body fittable on a side of the guide-plate section facing away from the conveying surface being connectable upstream of a respective blast-air nozzle of said second nozzle configuration, said nozzle body having spiral channels formed therein upon which blast air is actable, each of said spiral channels communicating with a respective one of the gaps distributed over 360°.

8. The guiding device according to claim 1, including blast-air ducts extending transversely to the sheet transport direction, said blast-air ducts communicating with said blast-air nozzles for supplying thereto blast air to act upon said blast-air nozzles.

9. The guiding device according to claim 1, wherein said inlet region is furnished with blast-air nozzles of a third nozzle configuration, said blast-air nozzles of said third nozzle configuration being formed with blast-air openings formed of holes in said guide-plate section.

10. The guiding device according to claim 1, wherein said inlet region is furnished with blast-air nozzles of said first nozzle configuration, said blast-air nozzles of said first nozzle configuration in said inlet region being aligned in such a manner that therewith producible airjets bundles are directed opposite to the sheet transport direction.

11. The guiding device according to claim 9, wherein said inlet region is also furnished with blast-air nozzles of said first nozzle configuration, the airjets bundles producible by said blast-air nozzles of said first nozzle configuration being oriented opposite to the sheet transport direction, said blast-air nozzles of said first nozzle configuration being disposed downstream from said blast-air nozzles of said third nozzle configuration, as viewed in the sheet transport direction.

12. The guiding device according to claim 1, in combination with a sheet-fed printing press.

* * * * *